US005440859A

United States Patent [19]

Cortese

[11] Patent Number: 5,440,859

[45] Date of Patent: Aug. 15, 1995

[54] BOARD OF LUMBER DEFECT REPAIR

[76] Inventor: Thomas F. Cortese, 3333 Guido St., Oakland, Calif. 94602

[21] Appl. No.: 62,794

[22] Filed: May 17, 1993

[51] Int. Cl.[6] ..... E02D 37/00; E04G 23/00; B27G 1/00

[52] U.S. Cl. ..... 52/742.1; 52/514.5; 52/514; 144/2 M; 144/332

[58] Field of Search ..... 52/514, 514.5, 743, 52/741.3; 144/2 M, 330, 332

[56] References Cited

U.S. PATENT DOCUMENTS

| | | | |
|---|---|---|---|
| 256,567 | 4/1882 | Holmes | 52/514 |
| 276,499 | 4/1883 | Story | 144/2 M |
| 1,594,739 | 8/1926 | Leash | 144/2 M |
| 1,689,705 | 10/1928 | Walker | 144/2 M |
| 1,703,890 | 3/1929 | Loetscher | 144/2 M |
| 1,976,722 | 10/1934 | Goss | 52/514 |
| 2,217,311 | 10/1940 | Goss | 52/514 |
| 2,263,536 | 11/1941 | Dike | 144/332 |
| 2,392,751 | 1/1946 | MacKenzie | 52/514 |
| 2,570,588 | 10/1951 | Nylund | 52/514 |
| 2,583,396 | 1/1952 | Skoog | 52/514 |
| 4,674,255 | 6/1987 | Derome | 52/514 |
| 4,894,971 | 1/1990 | Cortese | 52/514 |
| 4,941,305 | 7/1990 | Cortese | 52/514 |

*Primary Examiner*—Carl D. Friedman
*Assistant Examiner*—Robert J. Canfield
*Attorney, Agent, or Firm*—Harris Zimmerman

[57] ABSTRACT

Defects in wooden boards, such as knots, knotholes or cracks, are repaired by forming an opening in the board at the site of the defect and forming a plug that fills the opening. In some forms of the invention the opening has a shape which interlocks the plug to the board. In another form of the invention, the plug is held in place by a transversely extending resilient member that is embedded in the plug and which is under tension which causes edge portions of the member to bite into or bear against the adjacent wood. Forming the opening includes cutting away bark encasement tissue that may adjoin the defect which encasement can cause a discoloration upon painting of the board and may eventually loosen. In some forms of the invention, cracks are repaired by making plural saw cuts along a crack to form the opening with the saw having a different angling relative to the board during each saw cut. In another form of the invention, the opening and plug extend between opposite surfaces of the board and have a width which increases at a plurality of spaced apart locations within the board and decreases at a plurality of alternate locations.

18 Claims, 4 Drawing Sheets

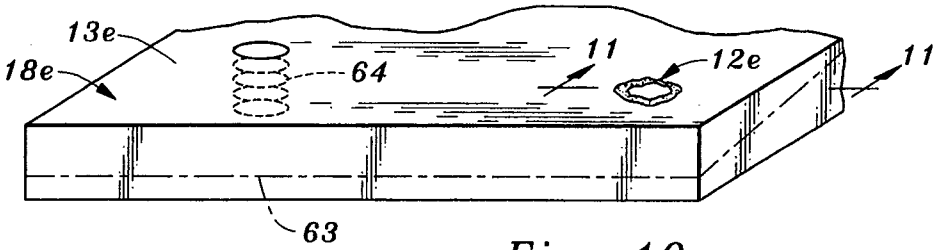
Fig. 10
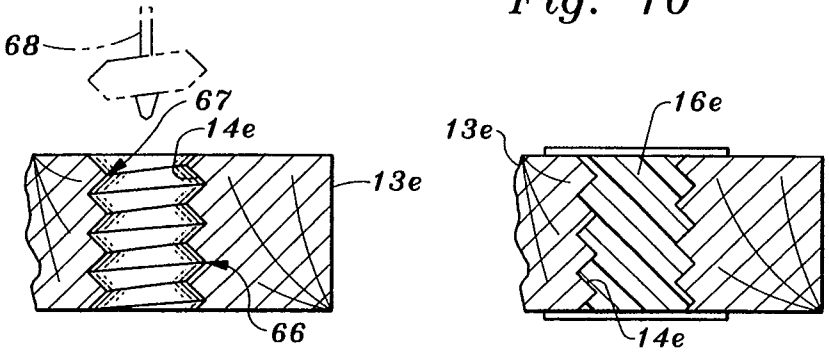
Fig. 11B
Fig. 11A
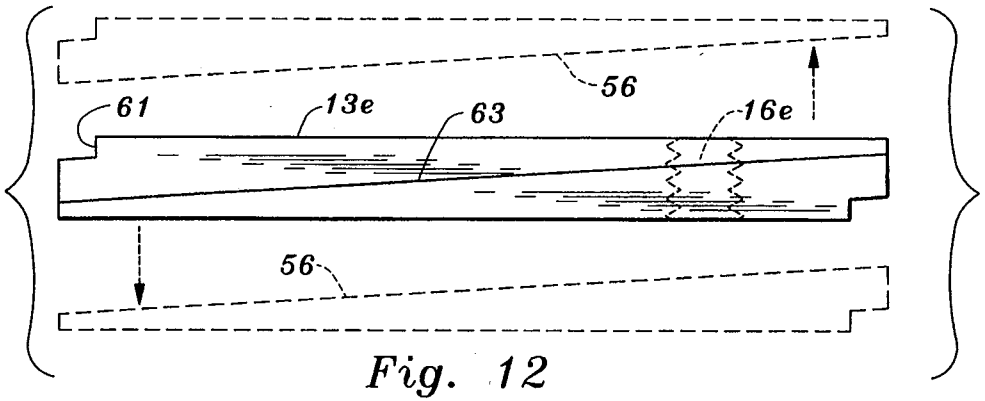
Fig. 12
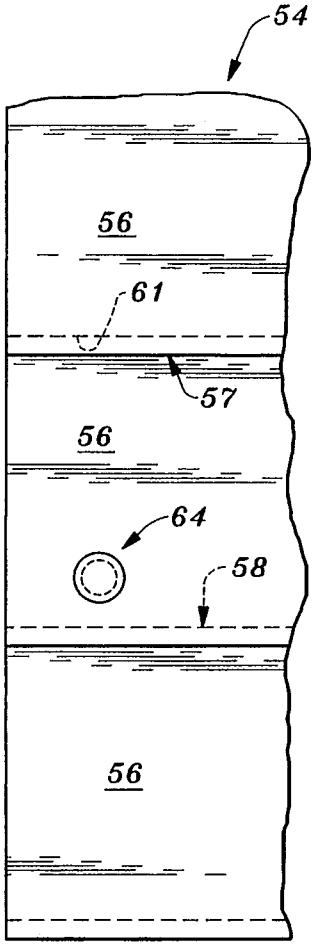
Fig. 8
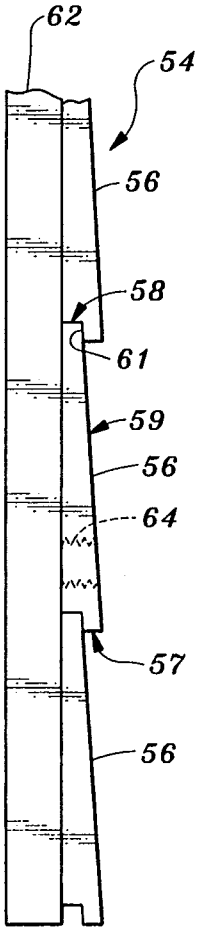
Fig. 9

BOARD OF LUMBER DEFECT REPAIR

TECHNICAL FIELD

This invention relates to the repair of defects in wooden boards or the like. More particularly, the invention relates to boards which are repaired by replacing knots, knotholes, cracks or other defects with filler materials and to methods for making such repairs.

BACKGROUND OF THE INVENTION

Defects such as knots, knotholes and cracks make wooden boards unsuitable or undesirable for many structural purposes. Knots, for example, may loosen and fall out after a period of time, may bleed pitch and may remain apparent after painting of the board. Open passages such as knotholes and cracks are inappropriate in many wooden constructions.

Defects of these kinds can be repaired by cutting an opening though the board at the site of the defect and then filling the opening with hardenable mastic or shaped pieces of wood that are adhered together and to the board by means of adhesive. My prior U.S. Pat. No. 4,894,971, issued Jan. 23, 1990 and entitled "Board Repair for Correcting Defects in Lumber or the Like", discloses a particularly advantageous process of this kind. In the repair process of that prior patent, the bore that is cut through the board at the defect site and which is filled with a plug has a width that changes at a first location within the bore and which undergoes a reversed change at another location in the bore. This interlocks the hardened plug material in place and provides a stronger and more durable repair than can be realized by relying solely on adhesive forces to hold the plug in place. My prior U.S. Pat. No. 4,941,305, issued Jul. 17, 1990 and entitled "Repair of Edge Defects in Boards of Lumber or the Like", discloses a method for repairing edge defects in boards that also interlocks the filler material into the board.

Knots and knotholes occur at locations where a branch extended from the trunk or another branch of the tree and the portions of the board that are adjacent the knot or knothole are formed of bark encasement tissue which differs from the wood of other regions of the board. Encasement tissue may also be present as a lining in cracks that existed prior to cutting of the tree. The bark encasement is harder than the adjacent wood, usually has a different coloration and is less absorbent of liquids such as paint.

I have found that the bark encasement can be a source of several problems in connection with board repairs of the hereinbefore discussed kind. The bark encasement does not accept paint as readily as the adjacent wood and filler plug material and may remain visible as a coloration discontinuity in the painted surface. The bark encasement may also detach from the adjoining wood after a period of time and the loosened encasement and plug filler material may than be ejected from the repair site.

In the repair methods of the above identified prior patents, the openings which receive a plug of filler material are formed by drilling passages into the board or by cutting away edge regions of the board. These techniques can be adapted to the repair of elongated cracks but it would be advantageous if the cutting operations involved in the repair of long cracks could be simplified.

Some milling operations, such as the manufacture of bevel siding for buildings, involve resawing of a sawn board along the length of the board to divide it into two boards of smaller thickness. In some instances, such resawing can cut through a repair plug of the above described kind in a manner which causes it to cease to be interlocked into the board. Thus it has heretofore been necessary to defer the repairs until after the resawing. This makes it necessary to perform two repairs to correct what was a single defect prior to the resawing operation. Filler plugs formed after the resawing also may not exhibit the same surface texture or appearance that is found on the contiguous surface of the wood as a result of resawing.

The present invention is directed to overcoming one or more of the problems discussed above.

SUMMARY OF THE INVENTION

In one aspect, this invention provides a method for eliminating a defect in a board of lumber which defect is bounded by bark encasement tree tissue. Steps in the method include cutting an opening through the board at the site of the defect and forming the opening to have a width that changes at a first location between the opposite surfaces of the board and which undergoes a reversed change at a second location between the surfaces. Further steps include forming a plug in the opening that fills the opening and which has end surfaces that are coplanar with the opposite surfaces of the board. Bark encasement tissue is cut out of the board in the process of cutting the opening at least at the portions of the board that are adjacent the opposite surfaces of the board.

In another aspect of the invention, a method of repairing an elongated crack defect in a board of lumber includes the step of cutting material away from the board to form the crack into an elongated slot having a width that changes at a first location between the opposite surfaces of the board and which undergoes a reversed change at a second location between the opposite surfaces. A plug is formed in the slot which fills the slot and which has surfaces that are coplanar with the opposite surfaces of the board.

In another aspect of the invention, the method of repairing an elongated crack defect includes the further steps of cutting the slot by making three cuts along the board in the direction of the crack. A first of the cuts is made with a saw blade that is sidewardly angled relative to the crack and a second intersecting cut is made with a saw blade that is sidewardly angled in the opposite direction. The third cut is made with a saw blade that is offset from the line of intersection of the first and second cuts. Portions of the board that are situated between the cuts are removed to provide the slot.

In another aspect the invention provides a method of repairing an elongated crack that extends into a surface of a board of lumber but does not penetrate through the board. Steps in the method include making first, second and third saw cuts along the crack that do not penetrate through the board to form first, second and third grooves in the board. The grooves are convergent at the surface of the board and diverge from each other within the board. The first, second and third grooves are then filled with a hardenable filler material.

In still another aspect of the invention, a method of repairing a defect in a board of lumber includes the steps of cutting an opening through the board at the site of the defect including forming the opening to have a width which increases at each of a first plurality of spaced apart locations between the opposite surfaces of the board and which decreases at each of a second plurality of spaced apart locations between the board surfaces, locations of the first plurality being alternated with the locations of said second plurality. A cohesive plug of filler material is formed in the opening and conforms in shape with the opening.

In another aspect, the invention provides a method of repairing a defect in a board of lumber, which includes the steps of cutting an opening through said board at the site of the defect which opening is of sufficient size to remove the defect from the board and forming plural indentations in the portions of the board that form the wall of the opening such as by wire brushing those portions within the opening. A cohesive plug of filler material is then formed in the opening which plug conforms with the opening including the indentations in the wall of the opening. In other situations, the indentations may be provided in any other opening in the board.

In another aspect of the invention, a method of repairing a defect in a board of lumber includes the steps of cutting an opening through the board at the site of the defect that is of sufficient size to remove the defect and implanting a resilient member in the opening in a transversely extending orientation. The resilient member is tensioned to enable entry of the member into the opening and to cause edges of the member to bite into the board material which is adjacent the opening. A cohesive plug of filler material is formed in the opening and extends continuously from one end of the opening to the other.

In still another aspect, the invention provides a repaired board of lumber or similar material having an elongated slot in the original material of the board that extends between opposite surfaces of the board and along a region of the board at which a crack defect has been enlarged in the process of cutting the slot. The slot is filled with a plug of filler material. The width of the slot and plug changes at a first location between the opposite surfaces of the board and undergoes a reversed change at a second location thereby interlocking the plug with the board.

In another aspect of the invention, a repaired board of lumber or similar material has an opening in the original material of the board which extends between opposite surfaces of the board at the site of a former defect. The opening has a width that increases at each of a first plurality of spaced apart locations between the opposite surfaces of the board and which decreases at each of a second plurality of locations between the opposite surfaces. Locations of the first plurality alternate with the locations of the second plurality. A cohesive plug of filler material is disposed in the opening and conforms in shape with the opening.

In a further aspect, the invention provides a repaired board of lumber or similar material having an opening in the original material of the board that extends between opposite surfaces of the board at the site of a former defect. A resilient member is disposed within the opening in a transverse orientation and has an edge which bites into the original material of the board that bounds the opening. A plug of cohesive filler material is disposed in the opening at each side of the resilient material and has end surfaces which are coplanar with the opposite surfaces of the board.

The invention provides for a more durable and reliable repair of defects in boards. Openings which are cut through the board at the location of defects such as knots can be filled with a conforming plug with assurance that the plug will remain locked in place over an extended period of time. The repaired areas of the board also accept paint in a uniform manner similar to the paint acceptance of other areas of the board. Thus there is no visible color variation at the site of the repair following painting and the painted repaired board appears similar to an undefective board after it has been painted. One embodiment of the invention provides board repairs which remain interlocked in place after the board is re-sawn to divide the board into two thinner boards and which exhibit the same surface texture as the areas of natural wood. Another embodiment simplifies board repair by enabling interlocking of filler plugs in drilled passages that may have a uniform width.

The invention, together with further aspects and advantages thereof, may be further understood by reference to the following detailed description of the preferred embodiments and by reference to the accompanying drawings.

BRIEF DESCRIPTION OF THE DRAWINGS

FIG. 8 is a frontal elevation view of building siding of the wooden bevel siding type which siding includes a defect repair employing the invention.

FIG. 9 is an end view of the repaired building siding of FIG. 8.

FIG. 10 is a perspective view of a portion of a board that is repaired and subsequently re-sawn to divide the board into two of the bevel siding boards of FIG. 8 and FIG. 9.

FIGS. 11A and 11B are partial cross section views taken along line 11—11 of FIG. 10 and which illustrate successive stages in the repair of a knothole defect in the board of FIG. 10.

FIG. 12 is a diagrammatic end view of the board of FIG. 10 illustrating the division of the board to provide two separate lengths of the bevel siding.

DETAILED DESCRIPTION OF THE PREFERRED EMBODIMENTS

Figure 1:
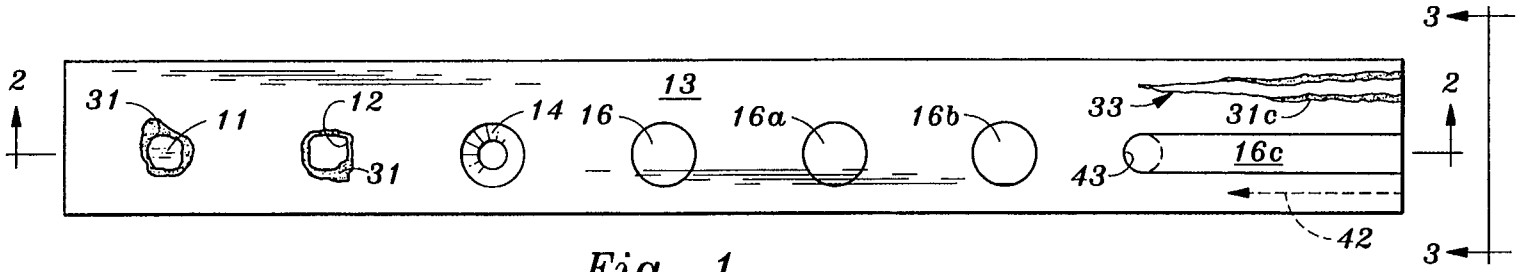
FIG. 1 is a view of a wooden board showing typical defects that may be present and showing successive stages in the repair of such defects in accordance with the preferred embodiments of the invention.
Figure 2:
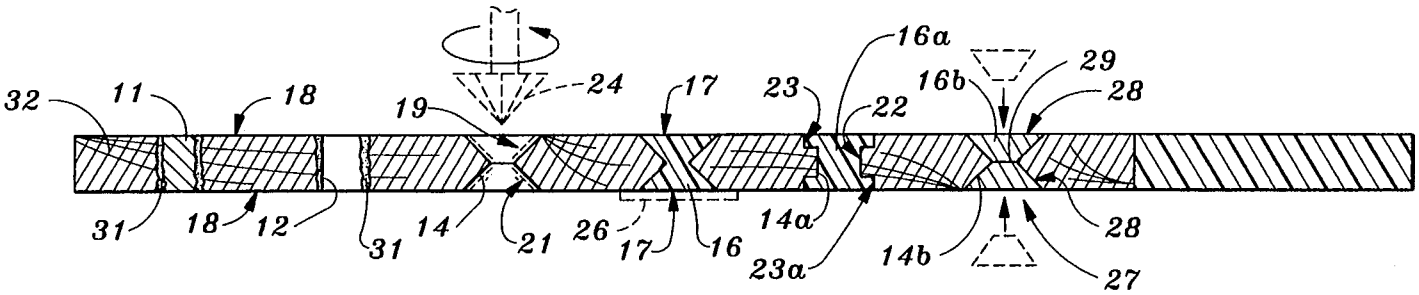
FIG. 2 is a section view of the board of FIG. 1 taken along line 2—2 thereof.

Referring initially to FIGS. 1 and 2 of the drawings in conjunction, the invention provides for repair of a defect such as a knot 11 or knothole 12 in a wooden board 13 by cutting an opening 14 through the board that removes the defect and then forming a plug 16 in the opening that fills the opening and which has end surfaces 17 that are coplanar with the opposite surfaces 18 of the board. Opening 14 is formed with a configuration that causes the plug 16 to be interlocked with the board 13. Thus the plug 16 is held in place by structural constraints and cannot drop out of the board 13 or be ejected from the board by external forces.

In this embodiment, such interlocking of the plug 16 is accomplished by forming the opening 14 to have a width that changes at a first location 19 between the opposite surfaces 18 of the board 13 and which undergoes a reversed change at a second location 21 between the board surfaces. A variety of different opening configurations meet this condition. Opening 14, for example, is a tapered bore that is of minimum diameter midway between board surfaces 18 and which progressively increases in diameter towards each board surface. Opening **14*a* containing another conforming plug 16*a* serves the same purpose and is formed by drilling a first bore 22 through the board 13 to remove a knot and then drilling larger diameter bores 23 part way into the board from each opposite surface, the bores 22 and 23** being coaxial. My previously identified prior U.S. Pat. Nos. 4,894,971 and 4,941,305 describe still other examples of opening and conforming plug configurations that lock the plug in place.

Suitable openings 14 may be formed with commonly available tools. Opening 14, for example, may be formed by drilling a bore through the center of the knot 11 with a drill bit (not shown) having a diameter corresponding to the minimum diameter of the opening 14 and then enlarging both ends of that bore with a countersink bit 24.

After the opening 14 is cut into board 13, the plug 16 may be formed by filling the opening with a mastic such as plastic wood or wood paste that is initially semiliquid and which cures to a hardened condition. A strip of adhesive tape 26 may be temporarily adhered to board 13 at the lowermost end of opening 14 during the filling and curing of the mastic to prevent it from adhering to the surface on which the board is supported.

The plugs 16, **16*a* may also be formed by shaping pieces of wood or other hard material to form an assembly which conforms with the openings 14, 14*a* and by unitizing the component pieces of the assembly with adhesive. For example, repair 27 has an opening 14*b* similar to that of of the previously described opening 14. The plug 16*b* in opening 14*b* is formed by two truncated conical pieces of wood 28 proportioned to fill the upper and lower halves of opening 14*b*. The abutting ends of pieces 28 are coated with adhesive 29 prior to emplacement of the pieces in opening 14*b* to unitize the plug 16*b*** and to lock the plug in place.

Durability of the board repairs is enhanced and unevenness in paint acceptance is avoided by cutting away portions of the board that adjoin knot 11 or knothole 12 during formation of the openings 14, **14*a*, 14*b*. In particular, a knot 11 in a wooden board 13 is usually encircled by an irregular ring of bark encasement 31 which tree tissue has a hardness and absorption properties and usually a coloration that differ from the corresponding properties of the knot and the adjoining wood tissue 32 of other parts of the board. When a knot 11 loosens and drops away leaving a knothole 12, the bark encasement 31 typically remains joined to the wood 32 of other portions of the board 13. At a later date, the encasement 31 may itself loosen from the adjoining wood 32 and be separated from the board 13 along with a repair plug 16, 16*a*, 16*b*** that is isolated from the adjoining wood by the encasement.

In accordance with the method of the invention, repair failure from this cause is avoided by cutting bark encasement tissue 31 out of the board 13 in the process of cutting the openings 14, **14*a* and 14*b* at least in the regions of the board that are adjacent the board surfaces 18. Preferably the encasement 31 is removed from all regions adjoining the openings 14, 14*a*, 14*b* to provide a repair that will remain permanently joined to the board 13 at all points of contact with the board. Removal of bark encasement 31 for this purpose can be easily accomplished by proportioning at least the outer regions of the openings 14, 14*a* and 14*b* to be of larger diameter than the bark encasement at the surfaces 18 of the board 13**.

Figures 3, 4A, 4B, 4C, 4D:
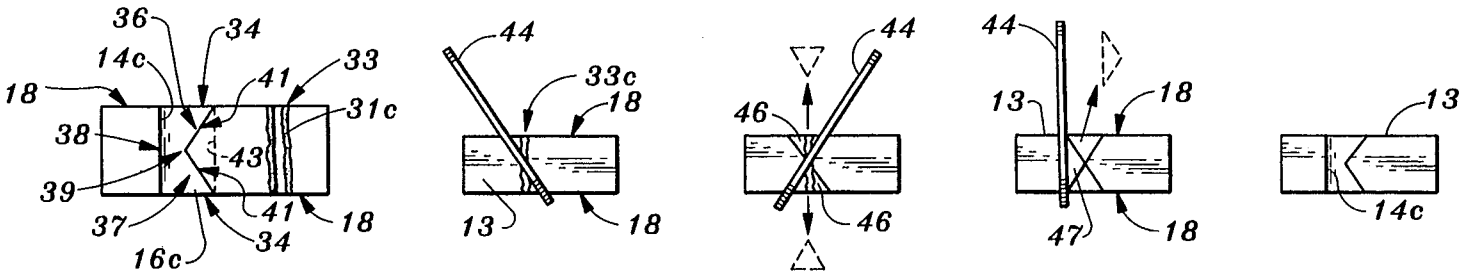
FIG. 3 is an end view of the board of FIG. 1 taken along line 3—3 thereof.
FIGS. 4A, 4B, 4C and 4D are end views of a board depicting successive stages in the repair of an elongated slot defect.

The hereinbefore described board repairs replace knots 11 or knotholes 12 and the openings 14, **14*a*, 14*b* which are formed in the course of the repairs are produced by drilling and are of circular shape. Longitudinal cracks 33 are another common defect found in wooden boards 13. Such cracks 33 may have a lining of bark encasement 31*c* if the crack existed while the tree's biological processes were still active. Referring jointly to FIGS. 1, 2 and 3, crack 33 defects can also be repaired by forming an opening 14*c* in the board in the form of a slot that extends along the site of the crack and by forming a conforming plug 16*c* that fills the slot and which has exposed opposite surfaces 34 that are coplanar with the surfaces 18 of the board 13. The filler plug 16*c* in this example is formed by hardening mastic within the opening 14*c*** in the manner previously described but can also be formed by adhering appropriately shaped pieces of wood or the like together essentially in the manner that has also been previously described.

To lock the plug **16*c* in place, the slot 14*c* has a width that changes at a first location 36 between board surfaces 18 and which undergoes a reversed change at another location 37 between those surfaces. In this example, the slot 14*c* has one planar side 38 that extends at right angles to the board surfaces 18 and an opposite side 39 which has first and second planar zones 41 that extend along the slot and which are angled relative to each other and relative to the planar side 38 of the slot. The angling of the zones 41 in this example causes the slot 14*c* to be widest at the board surfaces 18 but an opposite angling, which causes the slot to be relatively narrow at surfaces 18**, is also possible.

A slot opening **14*c* of the above described shape can be easily formed essentially by making three cuts with a saw in the direction of the crack as indicated by dashed arrow 42 in FIG. 1 after drilling a bore 43 through board 13 at the end of the slot. Bore 43** preferably has a diameter that exceeds the maxium width of the crack that is to be repaired including any bark encasement that may be adjacent to the crack.

Referring to FIG. 4A, a first cut is made with the saw 44 blade or rotary disk being sidewardly angled relative the crack 33*c* and with the saw in position to intersect the crack at a location that is between the board surfaces 18. A second saw cut is made with the saw 44 oppositely angled relative to the crack as shown in FIG. 4B and with the saw positioned to intersect the crack at the same location. This enables removal of the portions 46 of the board that are between the saw cuts as both cuts intersect the bore 43 (see FIGS. 1 and 3) at the end of the crack 33*c*. Referring to FIG. 4C, the third saw cut is made with the saw 44 offset from the line of intersection of the first and second saw cuts and preferably oriented at right angles to the board surfaces 18. Another portion 47 of the board 13 may then be removed to provide the slot 14*c* of above described shape as shown in FIG. 4D. The three cuts of the saw 44 need not necessarily be made in the above described order.

Referring again to FIGS. 1, 2 and 3, the configuration of slot 14*c* prevents longitudinal movement of the plug 16*c* along slot 14*c* as well as movement of the plug outward through board surfaces 18. The inner end of the plug 16*c* conforms with bore 43 and thus is wider than the portions of the plug that are located midway between board surfaces 18 at locations adjacent to the inner end. Consequently, longitudinal movement of the plugs 16*c* is blocked.

Figure 5:
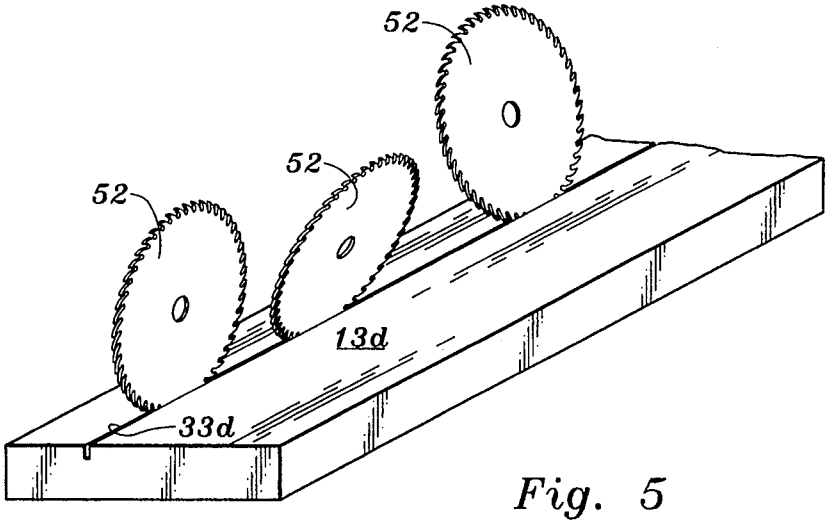
FIG. 5 is a perspective view of a portion of a board illustrating an initial step in the repair of a shallow crack that does not penetrate all the way through the board.

Referring to FIG. 5, another common board defect is a thin shallow crack 33*d* that does not penetrate all the way through the board. Such surface cracks 33*d*, which are usually no deeper than about one half inch, are usually caused by overly rapid drying of the green lumber by the effects of the sun and/or wind. Bark encasement does not form when such cracks develop after cutting of the tree.

Figure 6:
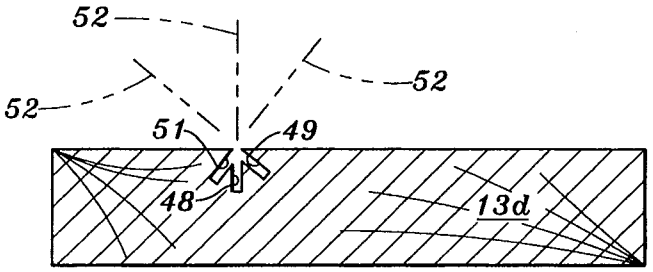
FIG. 6 is a cross section view of the board of FIG. 5 illustrating an intermediate stage in the repair of the shallow crank.

Referring jointly to FIGS. 5 and 6, surface cracks 33*d* of this kind can be easily and reliably repaired by making three saw cuts 48, 49 and 51 along the crack with the blade 52 of a rotary saw. For purposes of illustration, FIG. 5 shows three saw blades 52 being traveled along the crack 33*d* in tandem but the cuts can also be made with a single saw by making three passes along the crack. To interlock the repair into the board 13*d* each of the saw cuts 48, 49 and 51 is made with a saw blade 52 that is oriented at a different angle relative to the board surface 18*d*. Preferably, the first cut 48 is made with the blade 52 at right angles to the board surface 18*d*. The second cut 49 is made with the blade 52 tilted towards one side of the path of travel and the third cut 51 is made with the blade tilted in an opposite direction.

Figure 7:
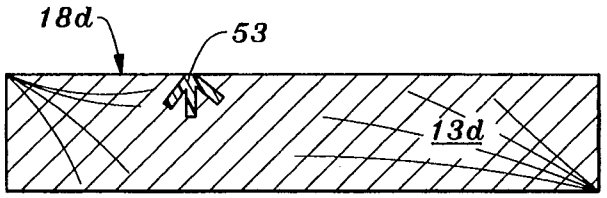
FIG. 7 is a cross section view corresponding to FIG. 6 and which depicts the completed crack repair.

The saw cuts 48, 49 and 51 are then filled with a hardenable material 53 such as epoxy adhesive or the like as shown in FIG. 7. As the cuts 48, 49 and 51 are convergent at the surface 18*d* of the board and diverge within the board, the hardened filler material 53 cannot be removed from the board.

The several forms of board repair which have been described up to this point are made on boards which have already been sawn to their final thickness. The interlocking of the filler material into the board may be disrupted if the repaired board is re-sawn to divide it into two thinner boards. Referring again to FIG. 2, if the repaired board 13 is sawn along a plane that is parallel to the board surfaces 18 and centered therebetween then the plug material 16 of each of the two thinner boards that are produced by the re-sawing is no longer structurally entrapped in the board. If the plane of the re-sawing is not centered between board surfaces 18, then the plug material 16 of one of the thinner boards is no longer entrapped while the plug material of the other remains interlocked.

There are instances where such re-sawing of repaired boards can be advantageous. Referring jointly to FIGS. 8 and 9, the outer walls of buildings are sometimes formed by bevel siding 54 which consists of a series of horizontally extending boards 56 each of which has a lower edge 57 that is thicker than its upper edge 58 and a slanted outer surface 59 that extends between such edges. The upper edge 58 of each board 56 except the uppermost one extends into a rabbet groove 61 in the lower edge 57 of an adjacent board and thus the successive boards are slightly overlapped. The boards 56 are nailed to the inner wall members such as studs 62.

Referring to FIG. 10, wasting of wood can be avoided by forming pairs of the tapered bevel siding boards from a thicker board 13*e* that is initially of the standard rectangular shape. This requires a re-sawing cut 63 along a plane within the board 13*e* that is slightly inclined relative to the board surfaces 18*e*. As previously discussed such re-sawing can disrupt the interlocking aspect of board repairs of the previously described kind. Consequently it is necessary to defer making such board repairs until after the re-sawing operation and the defect must be separately repaired on each of the two bevel siding boards. It is more efficient if a single repair can be made at the board 13*e* prior to the re-sawing.

FIGS. 10 to 12 depict an embodiment of the invention which can be emplaced prior to re-sawing and which provides an interlocked repair in each of the bevel siding boards 56 that are produced by the re-sawing.

Steps in making a repair 64 in accordance with this embodiment of the invention include forming an opening 14*e* which extends through the board 13*e* and which removes the defect 12*e* including any bark encasement that may adjoin the defect. As best seen in FIG. 11A, the opening 14*e* has a width which increases at a plurality of spaced apart locations 66 within the board 13*e* and which decreases at a plurality of spaced apart locations 67, the locations 66 being alternated with the locations 67. An opening of the depicted configuration can be formed by using a conventional router of which only the bit 68 is shown in the drawing.

Referring to FIG. 11B, the opening 14*e* is then filled with hardenable filler material to form a conforming plug 16*e*. Referring to FIG. 12, after hardening of plug 16*e*, the board 13*e* may be run through a planer for sizing and surfacing if needed, rabbets 61 may be cut and the re-saw cut 63 may be performed to produce the two bevel siding boards 56. The portions of the plug 16*e* which remains in the siding boards 56 continue to be interlocked in place as each such portion both increases and decreases in width within one of the boards 56.

Figure 13:
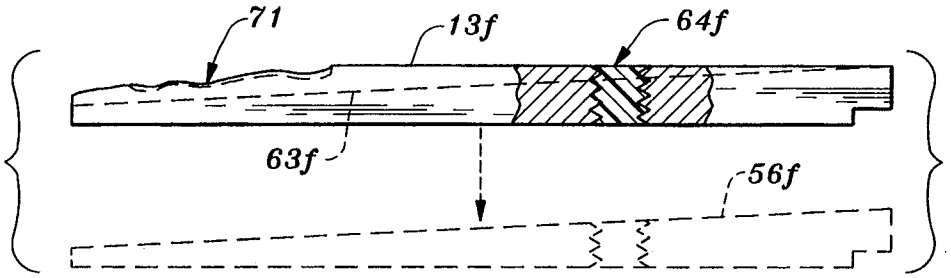
FIG. 13 is a broken out end view illustrating use of the invention to form bevel siding from a board that has an extensive surface defect as well as a knothole defect.

FIG. 13 depicts use of a similar defect repair to enable production of a single bevel siding board 56*f* from a defective board 13*f* which was intended to be rectangular but which has a wain or extensive area 71 of missing material at one surface. The repair 64*f* may be similar to that of the last described embodiment of the invention.

The re-sawing cut 63*f* removes the wain area 71 but does not affect the interlocking of plug 16f with the adjoining portions of the board 56*f* for reasons similar to those discussed with reference to the embodiment of FIGS. 8 to 12.

Figure 14A:
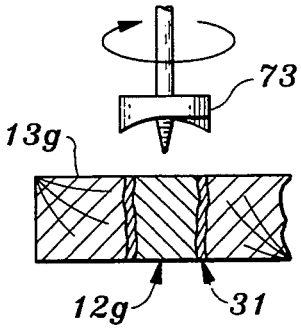
FIGS. 14A to 14D are section views of the same region of a board illustrating successive stages in the repair of a defect by another variation of the method.
Figure 14B:
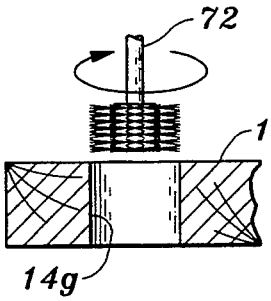
Figure 14C:
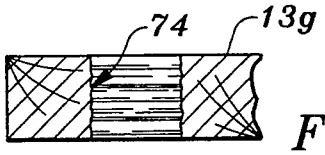

FIGS. 14A to 14E illustrate stages in a variation of the board repair process that can be performed very rapidly with the aid of a wire brush 72 which is preferably of the rotary type that engages in the chuck of a hand held electric drill set (not shown) although other forms of wood gouging devices may also be used. Referring to FIG. 14A in particular, the board defect 12*g* is again removed by drilling an opening 14*g* through the board 13*g* using a drill bit 73 of sufficient size to remove any bark encasement 31 that may be present. In some cases, where a suitable opening is already present, drilling may not be required. Referring jointly to FIGS. 14B and 14C, wire brush 72 is then inserted into opening 14*g* and is maneuvered to create indentations 74, gouges and the like in the board material that bounds the opening.

Figure 14D:
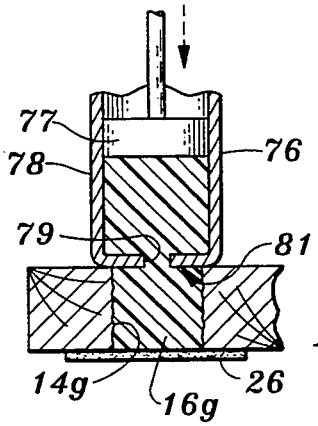
Figure 14E:
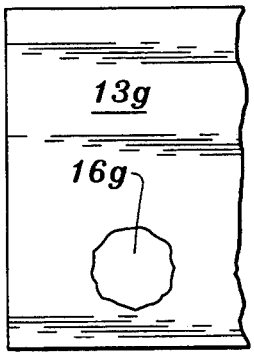
FIG. 14E is a top view of the board of FIGS. 14A to 14D following completion of the repair.

Referring jointly to FIGS. 14D and 14E, adhesive tape 26 is temporarily adhered to the underside of board 13*g* at the location of the opening 14*g* and the opening, including indentations 74, is then filled with hardenable filler material of the previously described kind to form a plug 16*g* that conforms with the opening and indentations. To assure entry of the filler into indentations 74, the filler material is preferably pressurized during formation of the plug 16*g*. This may be accomplished by utilizing a caulking gun 76 of the type having a slidable plunger 77 within a cylinder 78 which may be translated to force the filler material out of an aperture 79 at the end of the cylinder. The end surface 81 of cylinder 78, at which aperture 79 is located, is flat and is pressed against the surface of board 13*g* during injection of the filler material to form a seal which causes the downward movement of plunger 77 to pressurize the filler material within the opening 14*g*. Extension of portions of the plug into indentations 74 interlocks the hardened plug 16*g* with the original material of the board 13*g*.

This procedurre could be automated and, in these circumstances, the tape could be eliminated and suitable hardening filler could be inserted from one side of the board while the other side of the board is overlaying a plate or the like. Further, the plate could be heated in order to speed up the setting of the filler material. An upper plate could be used and the board with the filler material could be compressed between the plates to prevent escape of the filler material while in a flowable state.

It is also possible to use an expanding type filler material in any of the pre-arranged openings. By way of example, a plastic filler sold by the Willamette Valley Company of Eugene, Oreg., consisting of Epoxy A resin and Epoxy B hardener, expands after hardening and may be a preferred material for filing the openings.

Figure 15A:
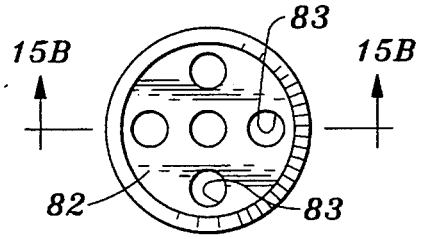
FIG. 15A is a plan view of a resilient disk which may be used to interlock a filler plug with original board material in accordance with another embodiment of the invention.
Figure 15B:
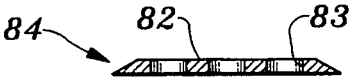
FIG. 15B is a cross section view of the disk of FIG. 15A taken along line 15B—15B thereof.

The previously described embodiments of the invention require openings at the site of a board repair that have specialized configurations for the purpose of interlocking a plug of filler material to the board. Referring to FIGS. 15A and 15B, the operations needed to impart such specialized shapes to the openings can be avoided by making use of a plug retainer member 82 which is formed of resilient material such as plastic or sawable metal. Member 82 is a circular disk in this example although the member may have other shapes. Member 82 has at least one and preferably more apertures 83 which enable filler material to flow between opposite sides of the disk and preferably has a sharp edge 84.

Figure 15C:
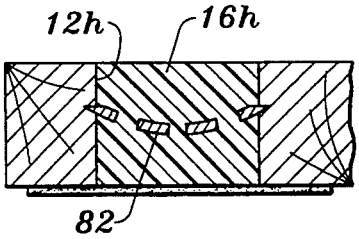
FIG. 15C is a section view of a board having a repair which utilizes the disk of FIGS. 15A and 15B.
Figure 15D:
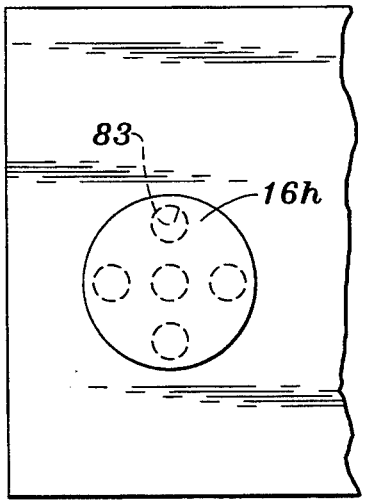
FIG. 15D is a top view of the repaired board of FIG. 15C.

Referring to FIGS. 15C and 15D, a board repair using the retainer member 82 is performed by drilling or otherwise forming an opening 12*h* in the original board material that removes the defect. The opening 12*h* has a diameter that is slightly smaller than the diameter of the member 82 when the member is in an untensioned condition. The member 82 is then forced into opening 12*h*, while being oriented transversely relative to the opening, by exerting pressure on the center of the member. This causes tensioning and diametrical contraction of the member 82 and imparts a concave shape to the member. Upon release of such pressure, the resiliency of the member 82 causes the member to expand. Consequently, the edge 84 of the member bites into the original material of the board that bounds the opening 12*h* or at least bears against such material to resist dislodgment of the repair. Opening 12*h* is then filled with hardenable filler material to form a conforming plug 16*h*. Apertures 83 in member 82 cause the plug 16*h* to be an integral block of filler that extends from one end of opening 12*h* to the other.

While the invention has been described with reference to certain particular embodiments for purposes of example, many modifications and variations are possible and it is not intended to limit the invention except as defined in the following claims.

I claim:

1. In a method of eliminating a defect in a board of lumber which has opposite surfaces and in which the defect is bounded by bark encasement tree tissue and wherein said defect is in the form of an elongated crack in said board, which method includes the steps of cutting an opening through said board at the site of said defect and cutting said bark encasement tissue out of said board in the process of cutting said opening therein at least at the portions of said board that are adjacent the opposite surfaces, forming the opening to have a width that changes at a first location between the opposite surfaces of the board and which undergoes a reversed change at a second location between the opposite surfaces of the board and forming a plug in said opening that fills said opening and which has end surfaces that are coplanar with the opposite surfaces of the board, including the further steps of forming said opening by making three cuts along said board in the direction of said crack, a first of said cuts being made with a saw blade that is sidewardly angled in a first direction relative to said opposite surfaces of said board, a second of said cuts being made with a saw blade that is sidewardly angled in an opposite direction which second cut intersects said first cut at a location that is between said opposite surfaces of said board and said third cut being made with a saw blade that is offset from the line of intersection of said first and second cuts, and removing the portions of said board that are situated between said cuts to provide said opening.

2. The method of claim 1 wherein said third cut is made with a saw blade that is substantially at right angles with said opposite surfaces of said board.

3. In a method of eliminating a defect in a board of lumber which has opposite surfaces and in which the defect is bounded by bark encasement tree tissue and which method includes the steps of cutting an opening through said board at the site of said defect and cutting said bark encasement tissue out of said board in the process of cutting said opening therein at least at the portions of said board that are adjacent the opposite surfaces, forming the opening to have a width that changes at a first location between the opposite surfaces of the board and which undergoes a reversed change at a second location between the opposite surfaces of the board and forming an unremovable plug in said opening by hardening filler material therein which plug fills said opening and which has end surfaces that are coplanar with the opposite surfaces of the board, including the further steps of forming said opening to have a width that increases at each of a first plurality of spaced apart locations between said opposite surfaces of said board and which decreases at each of a second plurality of spaced apart locations between said opposite surfaces of said board, locations of said first plurality being alternated with locations of said second plurality within said board and resawing said board along a plane which intersects said opening and said plug to divide said board into two thinner boards.

4. In a method of eliminating a defect in a board of lumber which has opposite surfaces and in which the defect is bounded by bark encasement tree tissue and which method includes the steps of cutting an opening through said board at the site of said defect and cutting said bark encasement tissue out of said board in the process of cutting said opening therein at least at the portions of said board that are adjacent the opposite surfaces, forming the opening to have a width that changes at a first location between the opposite surfaces of the board and which undergoes a reversed change at a second location between the opposite surfaces of the board and forming a plug in said opening that fills said opening and which has end surfaces that are coplanar with the opposite surfaces of the board, wherein said width of said opening is varied at different locations therein by wire brushing the board within said opening to form a plurality of separate indentations in the surface of said board that bounds said opening.

5. A method of repairing an elongated crack defect in a board of lumber which has opposite surfaces comprising the steps of cutting material away from said board to form said crack into an elongated slot having a width that changes at a first location between the opposite surfaces of the board and which undergoes a reversed change at a second location between the opposite surfaces of the board, forming a plug in said slot that fills said slot and which has surfaces that are coplanar with said opposite surfaces of said board, including the further steps of cutting said slot by making three three cuts along said board in the direction of said crack defect, a first of said cuts being made with a saw blade that is sidewardly angled in a first direction relative to said crack defect, a second of said cuts being made with a saw blade that is sidewardly angled in an opposite direction which second cut intersects said first cut at a location that is between the opposite surfaces of the board and said third cut being made with a saw blade that is offset from the line of intersection of said first and second cuts, and removing the portions of said board that are situated between said cuts to provide said slot.

6. The method of claim 5 wherein said third cut is is made with a saw blade that is oriented to be substantially at right angles with said opposite surfaces of said board.

7. In a method of repairing an elongated crack that extends into a surface of a board of lumber but does not penetrate through said board, the steps comprising:

making first, second and third saw cuts along said crack that do not penetrate through said board to form first, second and third grooves in said board that are convergent at said surface of said board and which diverge from each other within said board, and filling said first, second and third grooves with a hardenable filler material.

8. The method of claim 7 wherein one of said saw cuts is made with a rotary saw blade oriented at right angles to said surface of said board.

9. In a method of repairing a defect in a board of lumber which has opposite surfaces, the steps comprising:

cutting an opening through said board at the site of said defect including forming the opening to have a width which increases at a first plurality of spaced apart locations between the opposite surfaces of said board and which decreases at a second plurality of spaced apart locations between the opposite surfaces of said board, wherein locations of said first plurality alternate with the locations of said second plurality, forming a cohesive plug of filler material in said opening that conforms with said opening.

10. In a method of repairing a defect in a board of lumber which has opposite surfaces, the steps comprising:

cutting an opening through said board at the site of said defect including forming the opening to have a width which increases at a first plurality of spaced apart locations between the opposite surfaces of said board and which decreases at a second plurality of spaced apart locations between the opposite surfaces of said board, wherein locations of said first plurality alternate with the locations of said second plurality, forming a cohesive plug of filler material in said opening that conforms with said opening, and resawing said board along a plane which lies between the opposite surfaces of the board to divide the board into two thinner separate boards having lengths equal to the length of the original board, including forming said opening and said plug prior to said resawing of said board.

11. In a method of repairing a defect in a board of lumber, the steps comprising:

cutting an opening through said board at the site of said defect which opening is of sufficient size to remove said defect from said board, said opening having a wall formed by adjacent portions of said board, forming a plurality of separate indentations in the portions of said board that form the wall of said opening by wire brushing said board portions within said opening, and forming a cohesive plug of filler material in said opening that conforms with said opening including said indentations.

12. The method of claim 11 including the further step of forming said plug of filler material by injecting pressurized hardenable material into said opening.

13. In a method of repairing a defect in a board of lumber, the steps comprising:

cutting an opening through said board at the site of said defect which opening of sufficient size to remove said defect from said board, implanting a resilient member in said opening in a transversely extending orientation, said member having a diameter which exceeds the diameter of said opening, including flexing said resilient member to cause diametrical contraction of said member sufficient to enable entry of said member into said opening, and forming a cohesive plug of filler material in said opening that conforms with said opening and which extends continuously from one end of said opening to the other end thereof.

14. A repaired board of lumber or similar material having an elongated slot in the original material of the board that extends between opposite surfaces of the board and along a region of the board at which a crack defect in the board has been enlarged in the process of cutting the slot, said board further having a plug of filler material filling said slot and wherein the width of the slot and plug changes at a first location between said opposite surfaces of the board and undergoes a reversed change at a second location between the opposite surfaces thereby interlocking said plug with said board, wherein said slot has a first sidewall extending between said opposite surfaces of said board and which is of planar configuration and a second opposite sidewall that extends between said opposite surfaces, said second sidewall having portions thereof which are closest to said opposite surfaces of said board and another portion which is more distant from said opposite surfaces of said board, said second sidewall having an angled profile which causes the portions of said second sidewall that are closest to said opposite surfaces of said board to be further away from said first sidewall than the portion of said second sidewall that is more distant from said opposite surfaces of said board.

15. A repaired board of lumber or similar material having an elongated slot in the original material of the board that extends between opposite surfaces of the board and along a region of the board at which a crack defect in the board has been enlarged in the process of cutting the slot, said board further having a plug of filler material filling said slot and wherein the width of the slot and plug changes at a first location between said opposite surfaces of the board and undergoes a reversed change at a second location between the opposite surfaces thereby interlocking said plug with said board, wherein said slot has a first planar sidewall that extends between said opposite surfaces of said board substantially at right angles thereto and a second sidewall that extends between said opposite surfaces of said board in spaced apart relationship with said first sidewall, said second sidewall having first and second planar zones that extend along said slot and which are angled relative to each other and relative to said opposite surfaces of said board.

16. A repaired board of lumber or similar material having an opening in the original material of the board which extends between opposite surfaces of the board at the site of a former defect in the board which opening has a width that increases at each of a first plurality of spaced apart locations between said opposite surfaces of the board and which decreases at each of a second plurality of locations between said opposite surfaces of said board, locations of said first plurality being alternated with locations of the second plurality and wherein said increases and decreases of the width of said opening form a plurality of separate indentations in said original material of said board, further including a cohesive plug of filler material disposed in said opening including said indentations and which conforms therewith.

17. A repaired board of lumber or similar material having an opening in the original material of the board which extends between opposite surfaces of the board at the site of a former defect in the board, comprising:

a tensioned resilient member disposed within said opening in a transverse orientation therein, said member having a diameter in its untensioned state that is greater than the diameter of said opening and having edge portions which contact the material of said board that bounds said opening, and a plug of cohesive filler material disposed in said opening at each side of said resilient member and having end surfaces which are coplanar with said opposite surfaces of said board.

18. The repaired board of claim 17 wherein said resilient member is a circular disk having at least one aperture through which said plug of filler material extends.

* * * * *